US007552889B2

(12) United States Patent
Middelberg

(10) Patent No.: US 7,552,889 B2
(45) Date of Patent: Jun. 30, 2009

(54) WINDING-UP DEVICE PROVIDED WITH A RADIATION SOURCE FOR POSITIONING WINDING CORES

(75) Inventor: Gerhard Middelberg, Lengerich (DE)

(73) Assignee: Windmoeller & Hoelscher KG, Lengerich (DE)

( * ) Notice: Subject to any disclaimer, the term of this patent is extended or adjusted under 35 U.S.C. 154(b) by 335 days.

(21) Appl. No.: 10/556,555

(22) PCT Filed: May 11, 2004

(86) PCT No.: PCT/EP2004/005075

§ 371 (c)(1),
(2), (4) Date: Nov. 14, 2005

(87) PCT Pub. No.: WO2004/101405

PCT Pub. Date: Nov. 25, 2004

(65) Prior Publication Data

US 2007/0102557 A1 May 10, 2007

(30) Foreign Application Priority Data

May 13, 2003 (DE) ..... 103 21 600

(51) Int. Cl.
*B65H 35/02* (2006.01)

(52) U.S. Cl. ..... 242/525; 242/525.1; 83/520

(58) Field of Classification Search ..... 242/525, 242/525.1, 562.1, 563, 563.1–563.2; 83/520
See application file for complete search history.

(56) References Cited

U.S. PATENT DOCUMENTS 2,806,492 A * 9/1957 Becker ..... 83/520
3,949,948 A 4/1976 Tomma
4,155,515 A 5/1979 Schünmeier et al.
4,163,185 A 7/1979 Tokuno
4,833,782 A * 5/1989 Smith ..... 30/392
4,899,630 A 2/1990 Shioya et al.
5,546,840 A 8/1996 Supe-Dienes (Continued)

FOREIGN PATENT DOCUMENTS

DE 24 60 885 A1 7/1975

(Continued)

*Primary Examiner*—Sang Kim
(74) *Attorney, Agent, or Firm*—Jacobson Holman PLLC

(57) ABSTRACT

The present invention relates to a device (1) for winding sheet-shaped material (4), that comprises longitudinally cutting devices (11, 12, 13, 14), that cuts the sheet-shaped material (4) into different strips and winds it up on each of the winding sleeves (7*a*, 7*b*) arranged on the strips and in which at least one winding sleeve support (20) is provided on which the winding sleeves (7*a*, 7*b*) can be arranged in such a manner that each strip is wound up on a winding sleeve (7*a*, 7*b*) intended for it and in which sources of light (16) are arranged in such a manner that they can be used to illuminate the cutting positions of the sheet-shaped material (4) and/or the longitudinally cutting devices (11, 12, 13, 14) and at least one winding sleeve support (20).

The present invention is characterized in that the position of the sources of light (16) and that of the longitudinally cutting devices (11, 12, 13, 14) can be jointly displaced in the direction transverse (z) to the transport direction (x) of the sheet-shaped material (4).

13 Claims, 3 Drawing Sheets

U.S. PATENT DOCUMENTS

| | | | | |
|---|---|---|---|---|
| 5,848,761 | A | 12/1998 | Reinhold | |
| 6,305,635 | B1 | 10/2001 | Looser | |
| 6,595,460 | B1 * | 7/2003 | Jones | 242/538.2 |

FOREIGN PATENT DOCUMENTS

| | | | |
|---|---|---|---|
| DE | 26 38 735 | T | 9/1977 |
| DE | 39 14 184 | A1 | 12/1989 |
| DE | 42 36 288 | C1 | 12/1993 |
| EP | 0 501 123 | A1 | 9/1992 |
| WO | WO 99/06313 | A1 | 2/1999 |

* cited by examiner

PRIOR ART

WINDING-UP DEVICE PROVIDED WITH A RADIATION SOURCE FOR POSITIONING WINDING CORES

CROSS-REFERENCE TO RELATED APPLICATION

This is a nationalization of PCT/EP04/005075 filed May 11, 2004 and published in German.

BACKGROUND OF THE INVENTION

1. Field of Invention

The present invention relates to a winding device for winding up sheet-shaped material. Winding devices are known from a plurality of patent applications of which only WO 99/06313 and U.S. Pat. No. 5,848,761 are mentioned here as examples. Usually winders are classified into contact winders and turret winders.

2. Description of the Prior Art

In some winders, the material sheet is cut longitudinally with the purpose of thus producing several narrow sheets simultaneously that are then wound up on different winding sleeves.

Since the sheets must not move obliquely during their transport through the winder, it is necessary to position the winding sleeves on a winding sleeve support in such a manner that their edges lie at the same height in the direction of the width of the sheet as that of the cutting knives or that of the cutting lines in the original sheet.

In recent times, sources of light have been used for this purpose that preferably emit visible light and simultaneously illuminate a transport roller, the contact roller in case of contact winders, and the winding shaft in the preparation position. In doing so, the source of light can be displaced transverse to the conveying direction till the most line-shaped light beam extends along the cutting lines. The winding sleeves mounted next to one another on the winding shaft can now be adjusted according to the cutting edges on the basis of this line.

However, what has proved to be disadvantageous here is that such an adjusting device requires a complicated and additionally error-prone handling since the sources of light have to be first adjusted in such a manner that the light beams precisely meet the cutting edge before the winding sleeves can be positioned.

Therefore, the objective of the present invention is to suggest a device for winding up sheet-shaped material in which the winding sleeves can be adjusted more easily and thus more quickly according to the position of the cutting edges.

SUMMARY OF THE INVENTION

This objective is achieved with a winding device having the features described herein.

According to the present invention, the positions of the sources of light and of the longitudinally cutting devices can be displaced in the direction transverse to the transport direction of the material sheet. In this manner the additional separate adjustment of the source of light to the cutting lines in the material sheet, which is characteristic of devices of prior art, can be completely omitted. The outcome of this omission of a separate adjustment process implies a higher precision of adjustments.

In a first preferred embodiment of the present invention, there is a mechanical connection between the sources of light and the longitudinally cutting devices.

Here, it is advantageous if the longitudinally cutting device comprises at least one blade to which a source of light is attached. The blade can be mounted on a slide that can be displaced on a rail transverse to the transport direction of the sheet. The source of light can also be attached to this slide using a holder. The advantage of such an arrangement is a faster and easier positioning of the blade as well as of the sources of light.

In this connection, it is particularly advantageous if the optically active range of the source of light and the cutting line created by the longitudinally cutting device assume the same position in the direction transverse to the transport direction of the sheet.

In such an arrangement, the edges of the winding sleeves only have to be positioned on the beam of the source of light without the need of additional auxiliary means. A line aperture can be used to generate a beam that is so narrow that it extends precisely along the cutting lines. However, a laser, for example a line-generating laser, can also be used as a source of light.

In a particularly advantageous embodiment of the present invention, at least one source of light is arranged in a position from which it can illuminate at least three of the following elements of the winder: the preparation position of the winder, the winding position in which the winding sleeves are located during the winding process, a storage position assumed by the winding sleeves in the storage device, a transport position in which the cut strips move next to one another or the cutting position itself. The advantage here is that it is possible to adjust the winding sleeves in different places and also constantly monitor the adjustments during the winding process, so that errors in the winding process can be detected faster.

The present invention also comprises a longitudinally cutting device for installation into a winding device. Naturally, said longitudinally cutting device can be installed in an existing winding device. Such a longitudinally cutting device divides a sheet-shaped material into different strips and comprises at least one blade that is displaceable along a rod or a rail. This rod or rail can be inserted into the winding device preferably transverse to the transport direction of the sheet. The position of the blade can be adjusted by displacing it along this rod or rail in the direction traverse to the transport direction of the sheet. A source of light makes this longitudinally cutting device stand out. The position of this source of light can also be adjusted in the direction transverse to the transport direction of the sheet by displacing the blade.

Moreover, the present invention relates to a process for winding up sheet-shaped material according to the preamble of claim 7.

The process suggested here simplifies the adjustment process by a joint displacement of the position of the sources of light and of the longitudinally cutting device in the direction transverse to the transport direction of the sheet-shaped material. Here, a joint displacement means that both the longitudinally cutting device as well as the sources of light are displaced by a single process of adjustment.

BRIEF DESCRIPTION OF THE DRAWINGS

A particularly preferred embodiment of the present invention is explained more elaborately in the following description on the basis of the drawing. The individual figures of the drawing illustrate.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
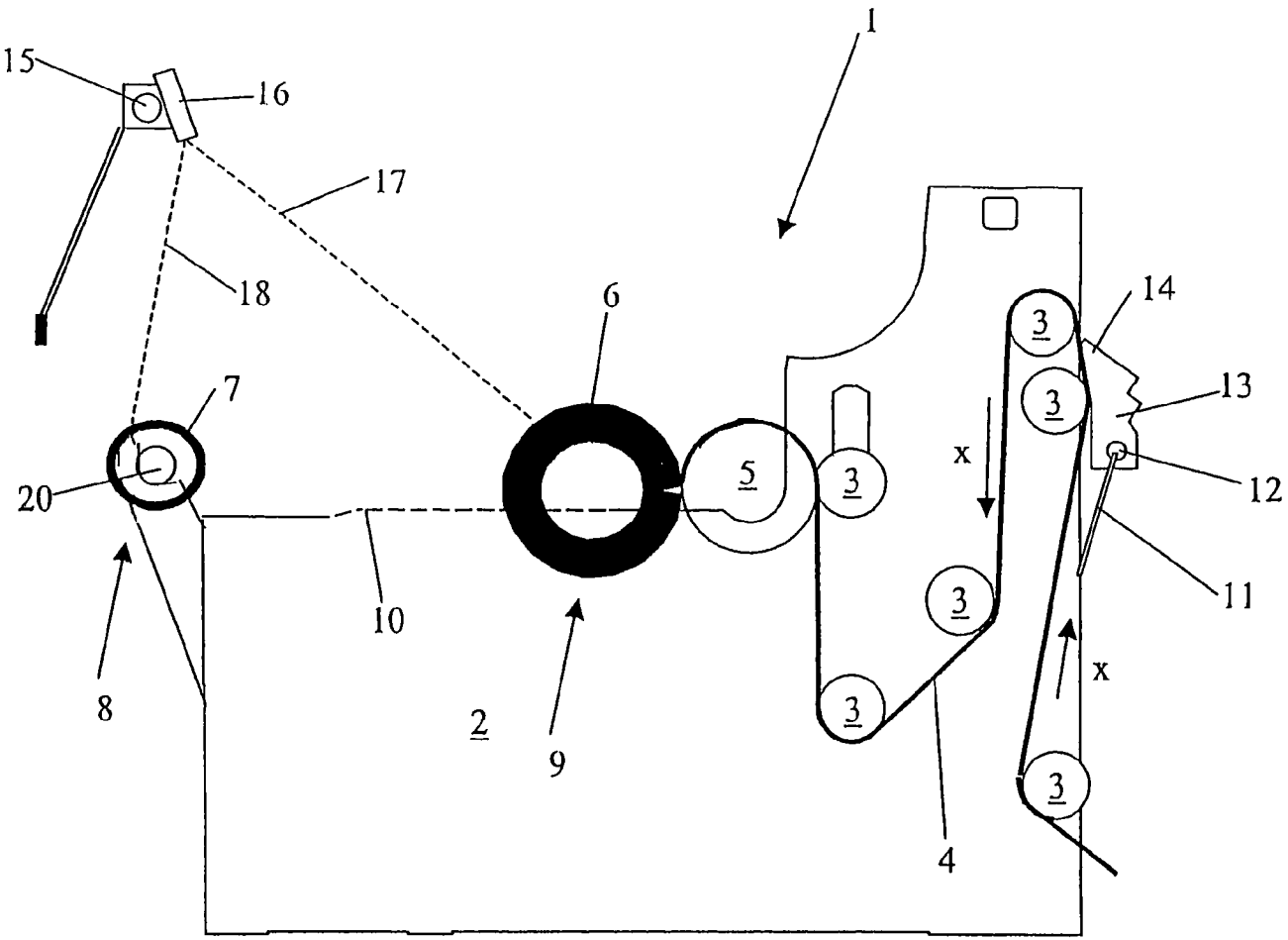
FIG. 1: the side view of a device for winding up sheet-shaped material according to prior art

FIG. 1 illustrates a winding device 1 according to the prior art for winding up a material sheet 4 into a roll 6. For this purpose, the material sheet 4 is guided over several deflector rollers 3 that are mounted in the machine frame 2. Subsequently, the material sheet 4 is guided over a contact roller 5 and then rolled up into the roll 6. The contact roller 5 is pressed against the roll in the known fashion so that the material sheet 4 is rolled up using a predetermined tension. A new winding sleeve 7, which is fitted on a winding sleeve support 20, is located in the preparation state 8 from where it can be conveyed over the bearing rails 10 into the winding position 9 after the removal of the completely formed roll 6.

In order to enable the production of two or more narrow material sheets from the material sheet 4, the blade/s 14 create/s one or more longitudinal cuts. For this purpose, the knives 14 penetrate into the material sheet 4 at the cutting position between two deflector rollers 3. The knives 14 are attached to the blade supports 13 which can be displaced over the rail 12 transverse to the transport direction x of the material sheet 4. The rail 12 is connected to the machine frame 2 using the holder 11.

In order to be able to wind up the resulting plurality of material sheets into independent rolls, both the roll 6 as well as the new winding sleeve 7 are subdivided into segments that are independent of one another and whose edges must correspond with the cutting lines in the material sheet 4. For the purpose of achieving a precise adjustment of the winding sleeve 7 to the winding sleeve support 20, sources of light 16 are mounted on a rail 15 so that they can be displaced transverse to the transport direction x of the material sheet 4. The rail 15 is connected to the machine frame 2 in a manner that is not illustrated here in more detail.

After positioning the knives 14 transverse to the transport direction x of the material sheet 4, the start of the material sheet 4 is conveyed to the roll 6. Subsequently, the sources of light 16 can be positioned in such a manner that the beams 17, which preferably have a line-shaped profile, illuminate the cutting lines in the material sheet 4. The beams 18 each of which assumes the same position transverse to the transport direction x of the material sheet 4 just as the beams 17, transmit these positions onto the new winding sleeve 7 whose segments can now also be adjusted in the direction transverse to the transport direction x of the material sheet 4.

Figure 2:
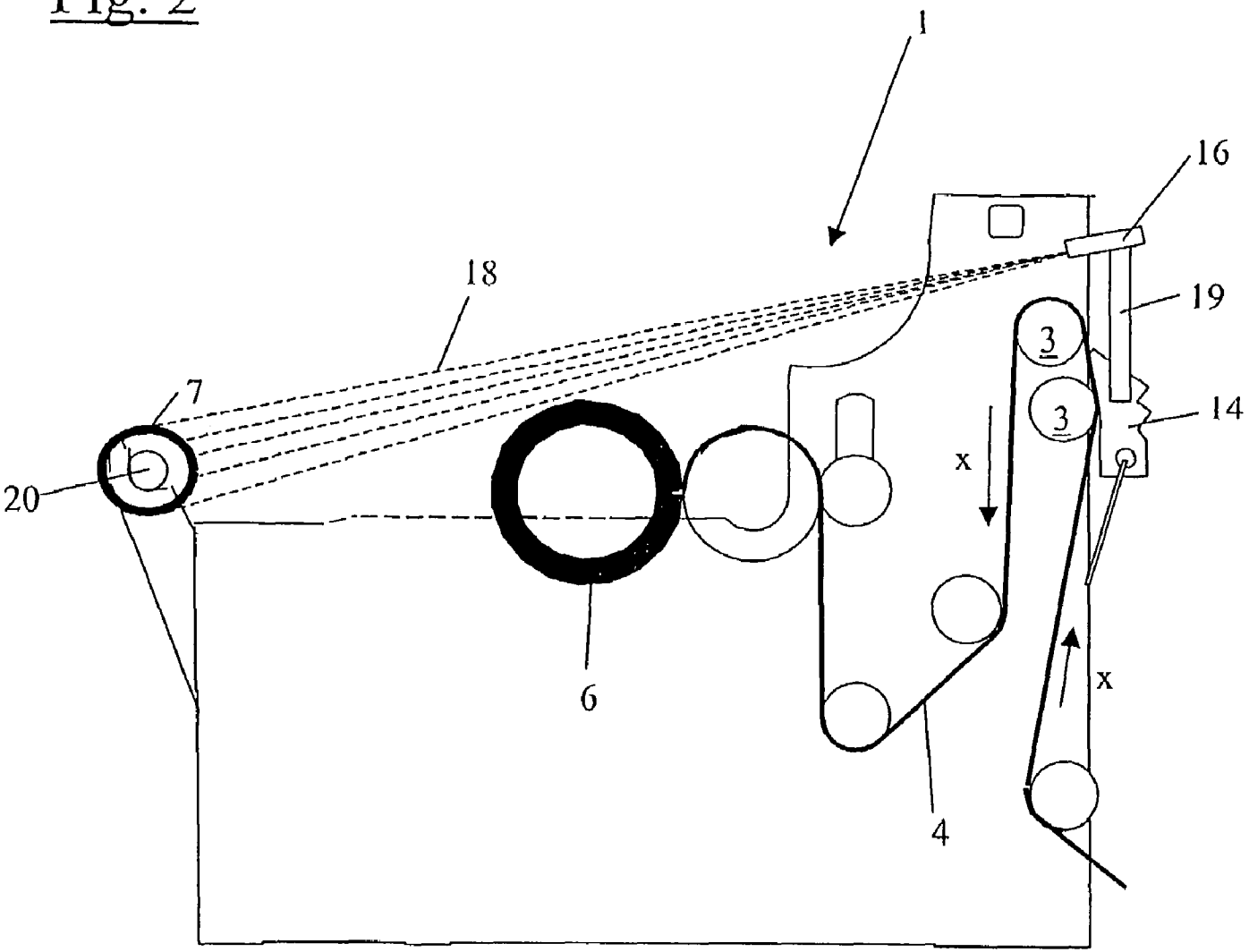
FIG. 2: the side view of a device for winding up sheet-shaped material according to the present invention.

FIG. 2 illustrates a winding device 1 according to the present invention that has a similar design as compared to the winding device 1 according to prior art.

However, the sources of light 16 are directly connected to the blade supports 13 using holders 19. During every change in the positions of the knives 14 transverse to the transport direction x of the material sheet 4, this position change is projected by the beams 18 onto the new winding sleeve 7. In the embodiment illustrated here, the beams 18 are also line-shaped and the positions of the beams 18 transverse to the transport direction x of the material sheet 4 correspond precisely with the positions of the knives 14. Therefore, even the individual segments of the winding sleeve 7 can be adjusted directly after the positioning of the knives 14 without the necessity of a prior readjustment of the sources of light 16.

Figure 3:
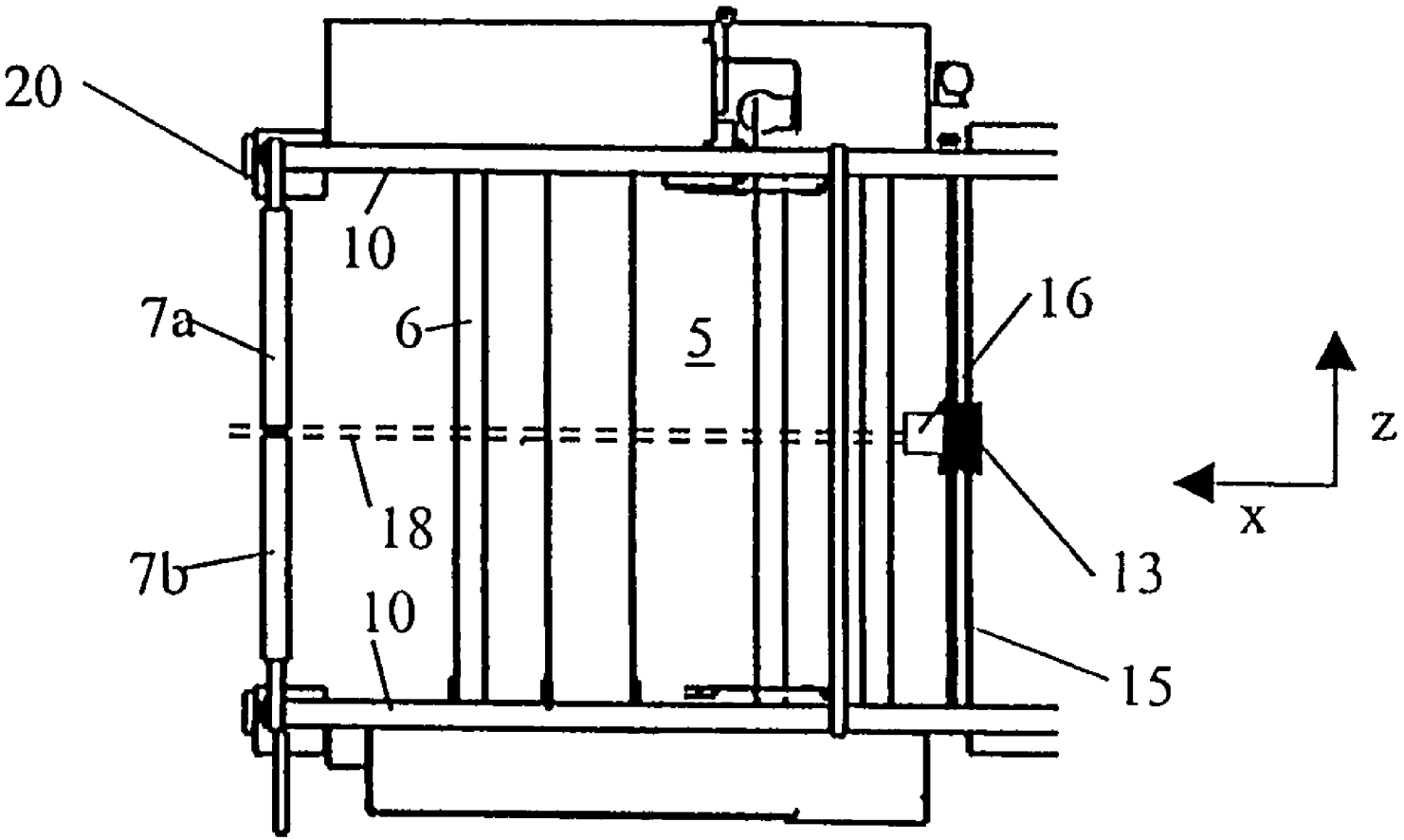
FIG. 3: a top view of the device illustrated in FIG. 2.

FIG. 3 illustrates the situation described in which the only source of light 16 illustrated is located directly above the blade hidden in the figure. The source of light 16 is adjusted in such a manner that the beam 18 extends along the cutting line. This arrangement can be used to position the edges of the segments 7*a*, 7*b* of the new winding sleeve 7 on the beam 18 and thus on the cutting line inserted into the material sheet 4.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Symbols

| | |
|---|---|
| 1 | Winding device |
| 2 | Machine frame |
| 3 | Deflector rollers |
| 4 | Material sheet |
| 5 | Contact roller |
| 6 | Roll |
| 7 | New winding sleeve |
| 7a, 7b | Segments of the new winding sleeve 7 |
| 8 | Preparation stand |
| 9 | Winding position |
| 10 | Bearing rails |
| 11 | Holder |
| 12 | Rail |
| 13 | Blade support |
| 14 | Blade |
| 15 | Rail |
| 16 | Source of light |
| 17 | Beam |
| 18 | Beam |
| 19 | Holder |
| 20 | Winding sleeve support |
| x | Transport direction of the material sheet 4 |
| z | Direction transverse to the transport direction z |

What is claimed is:

1. A device for winding up sheet-shaped material, the device comprising longitudinally cutting devices that cut the sheet-shaped material into different strips and wind the strips up on each of winding sleeves arranged on the strips, at least one winding sleeve support on which the winding sleeves are arranged such that each strip is wound up on a winding sleeve intended therefor, and sources of light arranged such that they illuminate cutting positions of at least one of the sheet-shaped material and the longitudinal cutting devices and at least one winding sleeve support, the sources of light and the longitudinally cutting devices being configured such that a position thereof is jointly displaceable in a direction transverse (z) to a transport direction (x) of the sheet-shaped material, and at least one of the sources of light being arranged at a position so as to illuminate at least three of a preparation position of the winding sleeves, a winding position in which the winding sleeves are located during a winding process, a storage position assumed by the winding sleeves in a storage device, at least one transport position in which the cut strips move next to one another, and a cutting position.

2. The device pursuant to claim 1, further comprising a mechanical connection between the sources of light and the longitudinally cutting devices.

3. The device pursuant to claim 2, wherein an optically active range of a beam of the source of light and the cutting position of the longitudinally cutting device are both arranged similarly in the direction transverse (z) to the transport direction (x) of the sheet-shaped material.

4. The device pursuant to claim 1, wherein the longitudinally cutting devices include at least one blade to which the source of light is attached.

5. The device pursuant to claim 4, wherein an optically active range of a beam of the source of light and the cutting position of the longitudinally cutting device are both arranged similarly in the direction transverse (z) to the transport direction (x) of the sheet-shaped material.

6. The device pursuant to claim 1, wherein an optically active range of a beam of the source of light and the cutting position of the longitudinally cutting devices are both arranged similarly in the direction transverse (z) to the transport direction (x) of the sheet-shaped material.

7. The device pursuant to claim 1, wherein the source of light is arranged at a position from which it illuminates the preparation position of the winding sleeves, the winding position in which the winding sleeves are located during the winding process, and the storage position assumed by the winding sleeves in the storage device.

8. The device pursuant to claim 1, wherein the source of light is arranged at a position from which it illuminates the winding position in which the winding sleeves are located during a the winding process, the storage position assumed by the winding sleeves in the storage device, and the at least one transport position in which the cut strips move next to one another.

9. The device pursuant to claim 1, wherein the source of light is arranged at a position from which it illuminates the storage position assumed by the winding sleeves in the storage device, the at least one transport position in which the cut strips move next to one another, and the cutting position.

10. A longitudinally cutting device for installation in a winding device in which the longitudinally cutting device cuts a sheet-shaped material into different strips, the longitudinally cutting device comprising at least one blade and a source of light, and being displaceable along a rail, being insertable into the winding device in a direction transverse (z) to a transport direction (x) of the sheet-shaped material, the position of the blade being adjustable by displacing it in the direction transverse (z) to the transport direction (x) of the sheet-shaped material, and the source of light being (i) adjustable in position in the direction transverse (z) to the transport direction (x) of the sheet-shaped material by displacing the blade and (ii) arranged at a position so as to illuminate at least three of a preparation position of winding sleeves onto which the strips are wound, a winding position in which the winding sleeves are located during a winding process, a storage position assumed by the winding sleeves in a storage device, at least one transport position in which the cut strips move next to one another, and a cutting position.

11. A process for winding up a sheet-shaped material, comprising cutting the sheet-shaped material by longitudinally cutting devices into different strips and winding the strips of material up on each of winding sleeves arranged on the strips, arranging winding sleeves on at least one winding sleeve support such that each strip is wound up on a winding sleeve intended therefor, and arranging sources of light such that they illuminate cutting positions of at least one of the sheet-shaped material, the longitudinally cutting devices, and at least one winding sleeve support, a position of the sources of light and of the longitudinally cutting devices being jointly displaceable in a direction transverse (z) to a transport direction of the sheet-shaped material, with at least one of the sources of light being arranged at a position so as to illuminate at least three of a preparation position of the winding sleeves, a winding position in which the winding sleeves are located during a winding process, a storage position assumed by the winding sleeves in a storage device, at least one transport position in which the cut strips move next to one another, and a cutting position.

12. A device for winding up sheet-shaped material, the device comprising:

at least one longitudinally cutting device that cuts the sheet-shaped material into different strips and winds the strips up on winding sleeves arranged on the strips;

at least one winding sleeve support on which the winding sleeves are arranged such that each strip is wound up on a winding sleeve intended therefore; and at least one source of light arranged such that the light source illuminates a cutting position of at least one of the sheet-shaped material, the longitudinal cutting device, and at least one winding sleeve support, the light source and the longitudinally cutting device being configured such that a position thereof is jointly displaceable in a direction transverse (z) to a transport direction (x) of the sheet-shaped material and such that the light source illuminates at least three of (i) a preparation position of the winding sleeves, (ii) a winding position in which the winding sleeves are located during a winding process, (iii) a storage position assumed by the winding sleeves in a storage device, (iv) at least one transport position in which the cut strips move next to one another, and (v) a cutting position.

13. The device according to claim 12, further comprising a mechanical connection between the light source and the longitudinally cutting device.

* * * * *